US006675418B1

(12) United States Patent
Armstrong

(10) Patent No.: US 6,675,418 B1
(45) Date of Patent: Jan. 13, 2004

(54) POST OPERATIVE PATIENT ASSIST DEVICE

(76) Inventor: Rene Armstrong, 170 Briarwood, Christiansburg, VA (US) 24073

( * ) Notice: Subject to any disclaimer, the term of this patent is extended or adjusted under 35 U.S.C. 154(b) by 0 days.

(21) Appl. No.: 10/195,644

(22) Filed: Jul. 12, 2002

(51) Int. Cl.[7] ..... A61G 7/053; A47C 21/00
(52) U.S. Cl. ..... 5/662; 5/81.1 R
(58) Field of Search ..... 5/81.1 R, 662; 294/152–156, 170; 482/904

(56) References Cited

U.S. PATENT DOCUMENTS 908,845 A * 1/1909 Curtin ..... 5/662
1,331,106 A * 2/1920 Hermanson ..... 24/600.9
2,843,858 A * 7/1958 Bjorklund ..... 5/662
2,927,329 A * 3/1960 Johannis ..... 5/662
4,679,265 A * 7/1987 Wicks ..... 5/662
5,131,707 A * 7/1992 Zazzara et al. ..... 294/156

* cited by examiner

*Primary Examiner*—Michael F. Trettel
(74) *Attorney, Agent, or Firm*—James W. Hiney

(57) ABSTRACT

A post operative patient assist device comprising two sections, one designed to attach the device to a bed frame or the like, and the second section having a series of gripping members flexibly connected one to the other in series so as to provide a chain of grips for the patient to successively engage with his or her hands to as to allow him or her to raise themselves from a supine position to a sitting position or vice versa.

20 Claims, 3 Drawing Sheets

POST OPERATIVE PATIENT ASSIST DEVICE

Patients who have had certain types of surgery focused on their abdominal region, such as appendicitis treatment, hysterectomies and caesarian deliveries, a few of the more common surgeries, have found that they have a great deal of difficulty in raising themselves in order to exit the bed, reach for an item near the foot of the bed, adjust their pillows for comfort and support, or to just sit up for awhile. These type of patients is on the rise with more than one in four women over 60 having hysterectomies and Caesarian deliveries accounting for approximately 23% of all deliveries these days. In addition, the number one injury to care givers at present is back injury incurred when attempting to assist patients rise from a sitting or supine position. With the hospital situation being what it is in these times, there simply are not nurses or aides handy to assist patients with most of their needs and when there are, there is usually a long wait after buzzing for one. Consequently, patients have to try and move themselves but the pain accompanying the post operative time period is so intense that they cannot just raise themselves up by bending the abdominal region quickly. To do so would also risk ripping out stitches and doing damage to the healing region. When nurses and aides assist them it is a very slow process to avoid damage to the area and to lessen the impact of the pain.

To solve this problem, various solutions have been proposed in the past but nothing has done the job in a way that allows the patient to control his or her ascent to the sitting position, is substantial so that even a large male can utilize it, is sufficiently secure to lessen any tendency of the patients hands to slip or to loose his or her grip due to lack of musculature in the hand or arms and that is adjustable to as to accommodate most people.

One such device is marketed by the Access With Ease company of Chino Valley, Ariz. which has a pull up strap consisting of a 40" loop which attaches around the leg or the bed frame and has 10" spacing in the strap. It essentially is a fabric ladder of sorts which relies on the patient to securely grip each transverse piece and pull themselves up. Naturally, this cannot be used secured to the patients leg if the patient has had surgery as that would exacerbate the pain and condition of the patient.

There are other, more grand devices such as patient lifts for lifting the patient either up or completely out of bed but these arrangements tend to be large, floor supported frames with a high lifting capacity and with swivels or rollers so as to swing the patient out and over the floor. These devices require a nurse or aide so that they are not patient initiated moves.

Another device that has been offered is a strap made of webbing that goes around the patient's foot who then attempts to pull themselves up. Of course, this does not work for most patients as it puts strain on the abdomen and thus defeats the very purpose of the device.

The instant invention is a vast improvement over the devices offered and/or utilized heretofore. It provides an easily stored, compact device which can be held in a storage area in a facility until a patient is in need of it.

The device is easily used by the patient and self-explanatory in terms of how each patient would employ it. It is fastened to the bed or bed frame or a portion thereof by a nurse or aide who then can leave the patient to his or her own inclination as to when to employ it. A patient may use it to lever them selves up to a sitting position as a final posture or to allow them to retrieve something or to allow them to then exit the bed from the side for attending to personal needs.

The device is made of material that in no way would harm the patient and with the use of non-slip handles it is not abrasive nor is it likely to impact the patient to produce bruising. The use of the material for the handles assures a firm grip that will not slip if the patient's hands become sweaty or are wet. The handle material assures a firm grip at all times and allows the patient to use both hands which, in elderly patients, is a big plus as their upper body and arm strength is usually diminished when compared to middle aged or younger patients.

The use of a hard central core in each hand piece assures a firm grip that will not be spongy thereby risking the patient losing control of the hand piece. The use of a plastic quick-release buckle assures an easy disconnect and the webbing content and size assures a sturdy device that will not fail or break.

Generally the device consists of a series of hand-pieces, which can be connected by eye-screws or the like screwed into individual wooden or plastic hand-pieces which are, in turn, covered with a no slip material. This material is thick enough to afford deflection by the fingers of the one gripping the hand-piece so that the lock of the grip is not affected by moisture or a minimum amount of strength in the patient's hand. Alternatively, the hand-pieces can be attached by fastening onto a length of cord which serves the same purpose as the swivels in allowing a flexible connection between the hand-pieces.

The series of hand-pieces, by which a patient gradually pulls himself or herself up hand over hand, is, in turn, connected by a plastic side release buckle to a continuous webbing which can be wrapped around a portion of the bed frame or some other secure anchorage. D-rings are used to connect the webbing to the eye-screw of the last handpiece.

OBJECTS OF INVENTION

Therefore, it is an object of this invention to provide a secure, non-slip assisting device for post-operative abdominal patients whereby they can elevate themselves from a supine position to a sitting position in a bed.

It is another object of this invention to provide an assisting device for abdominal surgery patients, which has a series of non-slip hand-pieces, linked together by swivel connections so as to provide a series of sure gripping surfaces for the patient to raise himself or herself to a sitting position without assistance from another.

It is a further object of this invention to provide a assisting device for surgical patients, which allows them to hoist themselves to a sitting position and lower themselves back down without assistance from another.

It is yet another object of the invention to provide an assisting device for nonsurgical individuals, which allow them to hoist themselves to a sitting position or to lower themselves to a reclining position without assistance from another.

It is a still further object of this invention to provide a series of linked gripping members connected to a bed attachment strap, which will allow post operative patients to raise themselves slowly to a sitting position without assistance thereby insuring that they do not injure themselves or cause injury to another in trying to raise them.

These and other objects will become apparent when reference is had to the accompanying drawings in which FIG. 1 is a top view of the first portion of this invention showing the grip members, and FIG. 2 is a top view of the strap portion of the invention showing the buckle and FIG. 3 is a side view of the invention showing the interconnection of the various portions, and FIG. 4 is a cut away view of one of the gripping members of FIGS. 1 and 2, FIG. 5 is a side view of a second embodiment of the invention 51.

Figure 1:
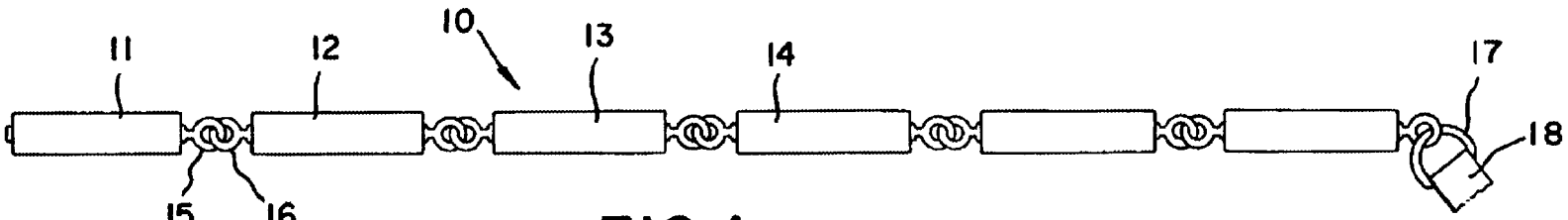
Figure 2:
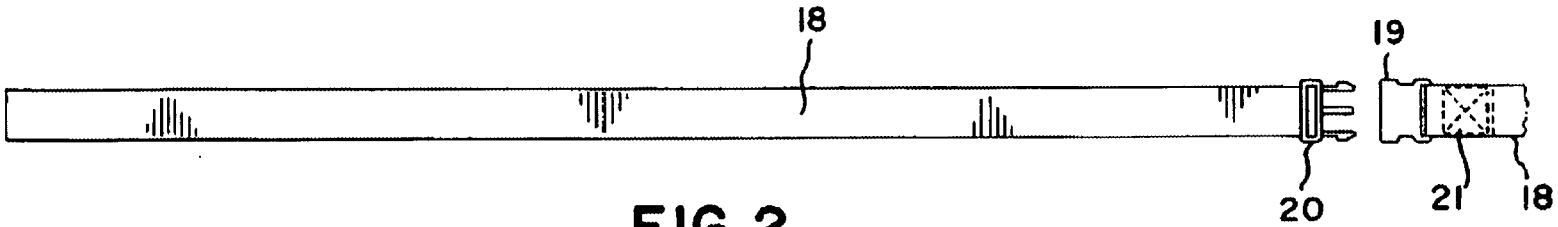
Figure 3:
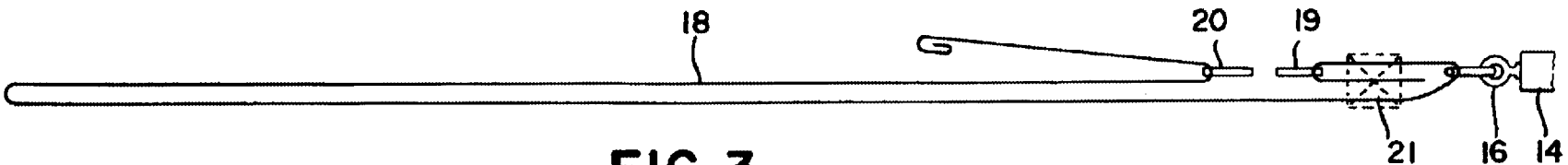
Figure 4:
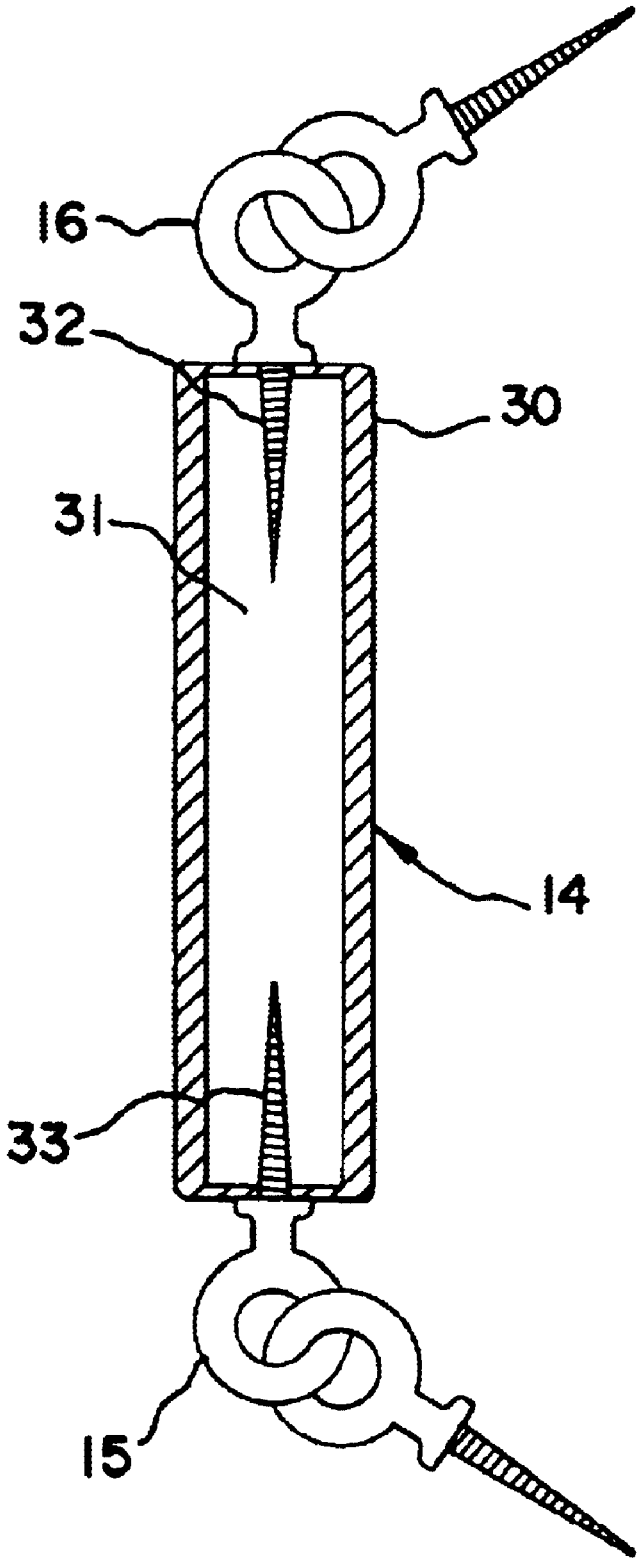
Figure 5:
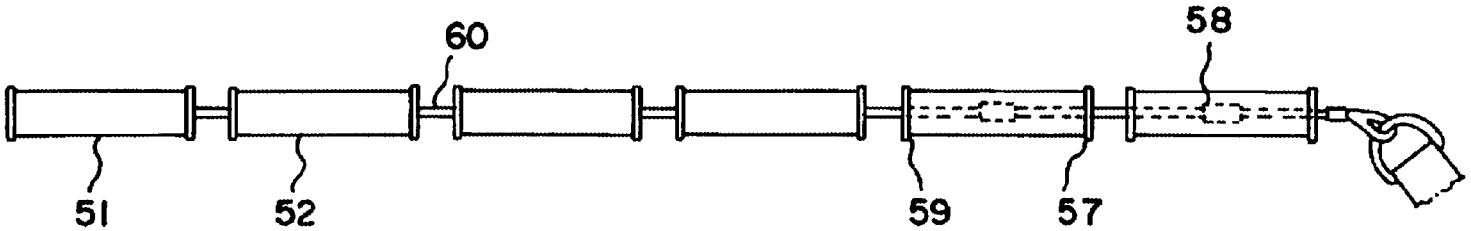
Figure 6:
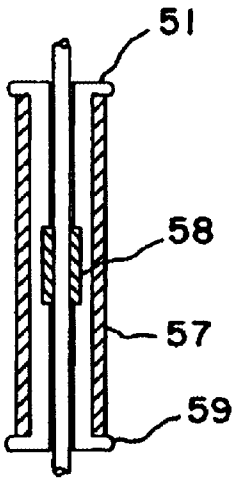
FIG. 6 is a sectional view of a typical hand-piece of the second embodiment.
Figure 7:
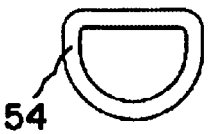
FIG. 7 shows a typical D-ring for securing the device together.
Figure 8:
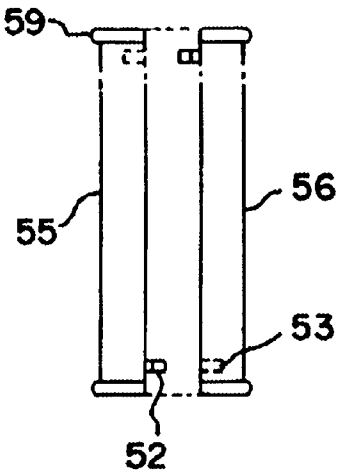
FIG. 8 shows a typical hand-piece of the second embodiment pulled apart.

Referring to FIG. 1 there is shown the device, 10, having a series of gripping members 11 through 14, which are linked together by, metal eye screws 15, 16 and which are connected at one end to a strap 18 via link 17. On strap 18 are buckle members 20 and 21, which snap together, and one of which has an adjustment portion 21 for adjusting the length of the strap. A user has the strap secured on an end of the bed and by pulling hand over hand on the gripping members or hand-pieces 11 and so on will gradually pull himself or herself up to a sitting position. Alternatively, the user may use the device to lower herself or himself to a supine position.

FIGS. 5 through 8 show a second embodiment 50 of the invention where the hand-pieces 51, 52, etc. are made of two plastic parts 55, 56, having male portion 52, and female portion 53 which snap together to surround a nylon cord 60. Each hand-piece or gripping member has a covering of a non-slip material 57 such as gel which affords a user a secure grip despite such factors as sweat or wet hands. Thus, the user is guaranteed a secure grip and does not have to worry about slipping due to moisture in one's palm. Within the two portions 55, 56 of a typical hand-piece is a crimp 58 which is used to crimp the hand-piece against slippage on cord 60. D-rings such as 54 afford a connection between the cord and the webbing of the invention. The hand-pieces have a lip 59 which keeps the gripping material 57 in place on each hand-piece or gripping member. Thus is it seen how a user may grip each successive hand-piece and pull them selves up to a sitting position or, conversely, lower themselves to a supine position. The device is flexible, easy to store and lightweight. The use of the successive gripping members with non-slip surfaces allow the user to obtain a firm grip and not have any portion of the gripping members cut into their palm or cause pain. The use of Nylon in the strap portion and the cord allows for an inexpensive material to be used and for strength which is important if the user is a large person.

Of course, the gripping members and cord may be molded as one piece by existing techniques and the strap can be molded as one piece with the cord portion. The use of plastics can be substituted for wood and other plastics used in lieu of Nylon and those mentioned herein. The molded gripping members can be treated to provide non-slip surfaces thereon which will act in the same way as the non-slip coverings shown and described such as gel.

While only two embodiments of the invention have been shown and described, it will be obvious to those of ordinary skill in the art that many other changes and modification and embodiments may be fashioned without departing from the scope of the appended claims.

What is claimed is:

1. A self-assisting post surgical device for patients that have some type of surgery which affects the abdominal region which allows them to gradually raise themselves from a supine position to a sitting position and vice-versa, said device comprising a first gripping section having a series of individual wood or plastic members flexibly linked together so as to allow a user to haul himself or herself up to a sitting position by grasping, consecutively, said individual members and pulling oneself upright, swivels driven into each member to firmly attach it thereto, and said swivels being linked from one member to another so as to provide substantial universal flexibility to said device when being used, a second section of said device having an adjustable portion thereof whereby the device may be anchored on a patient's bed or portions thereof to provide a firm attachment, and said second section being flexibly attached to said first gripping section.

2. A device as in claim 1 wherein each said member is a solid, generally cylindrical portion with a non-slip gripping surface sleeved thereon or coated thereon, said gripping surface being compressible by the hands of a user so as to allow a firm grip.

3. A device as in claim 1 wherein said second section of said device comprises a strap which can be looped around portions of a patient's bed to secure said device thereto.

4. A device as in claim 3 wherein said strap is Nylon.

5. A device as in claim 3 and including a plastic snap buckle having an adjustment means thereon on said strap so the length of said strap may be adjusted and be quickly detached from the portion of a bed.

6. A medical aid for assisting users who do not have abdominal strength to raise themselves from a supine position or vice-versa, said aid comprising a first portion having a series of hand grip members connected one to the other in series, said connected members allowing for twisting movement and to provide a user with means to pull said aid grip toward themselves, said hand grip members being compactable foam designed to prevent slipping by a user's hand, a second portion having a strap portion adapted to be secured to a bed or other permanent structure so as to anchor one end of the aid against movement, thereby allowing the gradual pulling of said grip members by a user to raise said user to a sitting or standing position or vice-versa.

7. An aid as in claim 6 wherein said first portion includes an elongated cord, said members secured onto said cord to form a series of members.

8. An aid as in claim 7 wherein each said grip member is shaped so as as to have a wider portion nearer the user so as to aid in not allowing slippage of a user's hand.

9. An aid as in claim 7 wherein each grip member is shaped to have a wider portion nearer the user so as to assist in preventing slippage of a user's hand.

10. An aid as in claim 7 wherein each said grip member is elongate and has a swivel member at each end, the swivel members being linked from one member to another to provide an elongated series of linked swivel members.

11. An aid as in claim 10 wherein each said grip member has an adjustment means thereon to allow for adjustment of the length thereof to accommodate different situations.

12. An aid as in claim 7 wherein said cord and said members are formed of one piece of plastic.

13. An aid as in claim 12 wherein each member portion has a compactable sleeve surrounding it.

14. An aid as in claim 6 wherein each said grip member is composed of two sections, the sections adapted to be snapped together by corresponding projections and indents.

15. An aid as in claim 6 wherein said first portion includes an elongated elastic cord, said members secured onto said cord to form a series of members.

16. An aid as in claim 15 wherein said grip members are secured to said cord by crimping devices, one for each grip member, thereby insuring that said grip members do not slide on said cord.

17. An aid as in claim 16 wherein said grip members are composed of two portions with corresponding male and female connectors, whereby said members may be snapped together around said cord and held in place by said crimping devices.

18. An aid as in claim 17 wherein each grip member has a lip on each end to prevent a non-slip covering from coming off of said member.

19. An aid as in claim 6 wherein each said compactible member is plastic.

20. An aid as in claim 6 wherein each said member has a compactible sleeve surrounding it.

* * * * *